US007944411B2

(12) United States Patent
Saeki

(10) Patent No.: US 7,944,411 B2
(45) Date of Patent: May 17, 2011

(54) CURRENT-DRIVE CIRCUIT AND APPARATUS FOR DISPLAY PANEL

(75) Inventor: Yutaka Saeki, Kanagawa (JP)

(73) Assignee: NEC Electronics, Kanagawa (JP)

( * ) Notice: Subject to any disclaimer, the term of this patent is extended or adjusted under 35 U.S.C. 154(b) by 1313 days.

(21) Appl. No.: 10/768,668

(22) Filed: Jan. 30, 2004

(65) Prior Publication Data

US 2004/0233183 A1 Nov. 25, 2004

(30) Foreign Application Priority Data

Feb. 6, 2003 (JP) ..... 2003-030091

(51) Int. Cl.
*G09G 5/00* (2006.01)

(52) U.S. Cl. ..... 345/76; 345/204; 345/77; 345/84; 345/94; 315/169.3; 315/170; 323/304; 327/100

(58) Field of Classification Search ..... 345/76, 345/204; 323/316; 315/169.3
See application file for complete search history.

(56) References Cited

U.S. PATENT DOCUMENTS

| | | | | |
|---|---|---|---|---|
| 5,847,556 | A * | 12/1998 | Kothandaraman et al. | 323/315 |
| 5,910,792 | A * | 6/1999 | Hansen et al. | 345/74.1 |
| 6,097,360 | A * | 8/2000 | Holloman | 345/84 |
| 6,188,395 | B1 * | 2/2001 | Yatabe | 345/211 |
| 6,222,357 | B1 * | 4/2001 | Sakuragi | 323/315 |
| 6,332,661 | B1 * | 12/2001 | Yamaguchi | 327/108 |
| 6,400,349 | B1 * | 6/2002 | Nagumo | 345/82 |
| 6,501,449 | B1 * | 12/2002 | Huang | 345/82 |
| 6,965,360 | B2 * | 11/2005 | DeCaro et al. | 345/76 |
| 6,971,742 | B2 * | 12/2005 | Nelson | 347/87 |
| 7,388,592 | B2 * | 6/2008 | Chuang et al. | 345/690 |
| 2002/0084812 | A1 * | 7/2002 | Nishitoba | 327/108 |
| 2003/0071677 | A1 * | 4/2003 | Shimozono | 327/538 |
| 2003/0122808 | A1 * | 7/2003 | Sase | 345/204 |
| 2003/0151374 | A1 * | 8/2003 | Maede et al. | 315/169.3 |
| 2005/0030273 | A1 * | 2/2005 | Shih et al. | 345/94 |

FOREIGN PATENT DOCUMENTS

| | | |
|---|---|---|
| JP | 11-355607 A | 12/1999 |
| JP | 2001-42827 | 2/2001 |
| JP | H13-42827 | 2/2001 |
| JP | 2001-350439 | 12/2001 |
| JP | 2002-244618 | 8/2002 |

* cited by examiner

*Primary Examiner* — Sumati Lefkowitz
*Assistant Examiner* — Grant D Sitta
(74) *Attorney, Agent, or Firm* — Muirhead and Saturnelli, LLC

(57) ABSTRACT

To equalize the intensity of light emitted by display elements on a display device, a plurality of current-drive circuits are connected in cascade through two terminals of each of the current-drive circuits, each comprising a reference current generation section including a reference resistor and a plurality of current drive sections. Reference current sunk by an external reference current source causes a voltage drop across the reference resistor, and the voltage drop is applied across a current adjustment resistor In response to an image signal, the current-drive circuit outputs current, determined by multiplying each of a plurality of internal reference currents by an optional factor and summing the resulting currents to the display elements. Since the magnitude of the internal reference current flowing inside the current-drive circuit can be varied by varying the value of the current adjustment resistor, gamma correction can be applied to drive current with high accuracy.

12 Claims, 15 Drawing Sheets

CURRENT-DRIVE CIRCUIT AND APPARATUS FOR DISPLAY PANEL

BACKGROUND OF THE INVENTION

1. Field of the Invention

The present invention relates to a current-drive circuit and apparatus for display panel, and particularly to a current-drive circuit and apparatus allowing a display panel to incorporate display elements thereon so that uniformity in light-emission intensity is improved.

2. Description of the Related Art

In recent years, as semiconductor elements become smaller and smaller in response to progress in micro-processing techniques, LSI (Large Scale Integrated Circuit) incorporating such semiconductor elements becomes larger and larger. For example, in a display device such as a liquid crystal display device, an output circuit, provided in a drive circuit, for driving data lines receives 8-bit digital data for display of one pixel and produces voltages for display of 256 gray scale 2-dimensional images so that the voltages are applied to and then drive liquid crystal, in order to achieve a liquid crystal display panel capable of displaying 16,770,000 colors.

That is, when analog images are converted to digital data, an 8-bit or 16-bit signal is used to relate a gray scale to a particular intensity level. To reproduce monochrome images, 1-bit information, i.e., 2 gray scale representation, in which "0" and "1" represent black and white respectively, is used as a minimum number of gray-scale levels.

On the other hand, as is known in the art, to reproduce color images, three primary colors, red (R), green (G) and blue (B), are blended. For example, when red (R), green (G) and blue (B) are represented at 256gray scale levels, totally, 16,770,000 colors can be displayed according to the calculation: 256×256×256=16,770,000.

A current-drive device employed in a drive circuit for such display panel is disclosed in Japanese Patent Application No. 13 (2001)-42827. The conventional current-drive device disclosed in the above-described publication is configured to include a plurality of current-drive Integrated Circuits (hereinafter, referred to as ICs) connected in series as shown in FIG. 1. Referring to FIG. 1, a plurality of current-drive ICs 1 through 4, each employing a current mirror circuit as a constant current source, and a reference current source 5 are inserted between a high voltage supply and a low voltage supply, and current mirror circuits incorporated within each of the plurality of current-drive ICs are connected in cascade to allow current passing through the plurality of current-drive ICs to become approximately equal to one another.

When current mirror circuits within the above-described current-drive IC consist of a MOS transistor, variations in the threshold voltage VT of MOS transistor increases variations in currents passing through the current-drive IC chips in proportion to the number of current-drive ICs.

Another current-drive device employed in a drive circuit for display panel is disclosed in Japanese Patent Application No. 14 (2002)-244618 and shown in FIG. 2. Referring to FIG. 2, the current-drive device comprises a current supply unit 22 and a sink-current adjustment unit 23. The current supply unit 22 includes reference current sources I1, I2, . . . . , In for sourcing different levels of currents, and a plurality of switches SW1, SW2, . . . , SWn configured to receive currents from the reference current sources I1, I2, . . . , In and switch between ON and OFF states in response to control signals D1, D2, . . . , Dn, thereby appropriately combining currents from the reference current sources I1, I2, . . . , In to output current of a particular level. In this case, the plurality of switches SW1, SW2, . . . , SWn have one ends connected respectively to the reference current sources I1, I2, . . . , In and the other ends connected together. The sink-current adjustment unit 23 receives the reference current of a particular level as a result of outputs from the switches SW1, SW2, . . . , SWn and then adjusts the level of sink current, and further, outputs the sink current of a particular level to one of data lines connected to individual pixels.

The above-described example represents a general current-drive circuit and when each of primary colors is to be represented, for example, at n-bit gray scale levels, the current-drive circuit supplies current of a particular level by combining binary-weighted constant currents I1 to In.

However, a current-drive circuit for supply of binary-weighted constant currents cannot guarantee monotone increase in output current when output current to be supplied to a display panel is monotonically increased because adjacent constant currents are different from each other by a factor of 2. Therefore, the current-drive circuit is neither able to increase or decrease current with high resolution nor to supply current for representing a particular color at the greater number of gray scale levels. Furthermore, the above-described current-drive circuit cannot apply gamma correction with high accuracy to output current corresponding to a digital signal.

Still another conventional drive device employed in a drive circuit for display panel is disclosed in Japanese Patent Application No. 13 (2001)-350439. The image display device disclosed in the above publication applies gamma ($\gamma$=2.0) correction to drive current corresponding to a digital signal by adjusting both the level and pulse width of drive current. However, since the drive current comes to have small pulse width at the representation of lower number of gray scale levels, the drive current that is able to drive a light-emitting element at a particular brightness level cannot potentially be supplied.

As described above, in case of the conventional current-drive apparatus for display panel disclosed in Japanese Patent Application No. 13 (2001)-42827, the current-drive apparatus is constructed such that a plurality of current-drive ICs IC1 to IC4 are connected in cascade and current mirror circuits are connected in cascade within each of the plurality of current-drive ICs IC1 to IC4, and nearly equal current is generated to flow within each of the plurality of current-drive ICs IC1 to IC4. However, when each of the current mirror circuits is constituted by MOS transistors, variations in threshold voltage of MOS transistor unfavorably increase the degree of variations between the current-drive ICs in proportion to the number of the current-drive ICs.

Furthermore, in case of the current-drive apparatus disclosed in Japanese Patent Application No. 14 (2002)-244618, combining any of binary-weighted constant currents I1 to In makes it difficult to supply current for representing a particular color at the greater number of gray scale levels because monotone increase in output current as an aggregation of the binary-weighted constant currents from the current-drive circuit is deteriorated. Furthermore, the current-drive circuit cannot apply gamma correction with high accuracy to output current corresponding to a digital signal.

Additionally, in case of the current-drive apparatus disclosed in Japanese Patent Application No. 13 (2001)-350439, the image display device applies gamma correction to drive current corresponding to a digital signal by adjusting both the level and pulse width of drive current. However, when the drive current becomes very small in magnitude, the response speed of the drive current in a MOS transistor circuit is potentially lowered.

SUMMARY OF THE INVENTION

In consideration of the above-described problems, the present invention has been conceived to provide a current-drive apparatus capable of causing-currents, which are generated by reference to current provided by a reference current source, to flow uniformly inside a plurality of current-drive ICs for a display panel and outputting drive currents with high accuracy through the current-drive ICs to the display panel, and further, applying gamma correction to the drive currents.

A current-drive apparatus according to the invention includes: a plurality of current-drive circuits connected in cascade and configured so that each of the plurality of current-drive circuits comprises a reference current generation section including a reference resistor and operating so that a reference current generated from outside the plurality of current-drive circuits is allowed to flow through the reference resistor and at least one internal reference current is generated in response to flow of the at least one internal reference current; and a reference current source allowing the external reference current to flow through the plurality of current-drive circuits, in which the current-drive circuit is operable to sum up the at least one internal reference current in a desired number and output a desired number of internal reference currents to a display element of the display panel.

Furthermore, the current-drive apparatus is constructed such that the reference current generation section further includes a plurality of current adjustment resistors and operates so that a reference voltage generated across the reference resistor is applied across each of the plurality of current adjustment resistors to generate the at least one internal reference current.

According to the above-described configuration of current-drive apparatus, single reference current is allowed to flow through the reference resistor included in each of the plurality of current-drive circuits, thereby eliminating variations in the magnitude of reference currents flowing through the reference resistors of the plurality of current-drive circuits.

According to a first aspect of the inventive current-drive apparatus for a display panel, the reference resistor of the current-drive circuit chosen out of the plurality of current-drive circuits and located on the side of a high voltage supply is connected to the high voltage supply through a voltage adjustment resistor and the reference resistor of the current-drive circuit chosen out of the plurality of current-drive circuits and located on the side of a low voltage supply is connected to the reference current source.

According to a second aspect of the inventive current-drive apparatus for a display panel, each of the plurality of current-drive circuits includes a voltage adjustment circuit connected to a terminal of the reference resistor on the side of a high voltage supply and wherein the plurality of current-drive circuits are configured so that when the plurality of current-drive circuits are biased, only the voltage adjustment circuit of the current-drive circuit chosen out of the plurality of current-drive circuits and located on the side of a high voltage supply has a voltage drop and the remainder of the plurality of current-drive circuits is short circuited.

The use of the first and second aspects of the inventive current-drive apparatus for a display panel allows a reference voltage across the reference resistor to securely be applied across the current adjustment resistor included in the current-drive circuit chosen out of the plurality of current-drive circuits and located nearest to the high voltage supply and further, permits variations in voltages across the current adjustment resistors included in the plurality of current-drive circuits to be reduced.

A current-drive circuit according to the invention includes: a reference current generation section having a reference resistor and operating so that a reference current generated from outside the current-drive circuit is allowed to flow through the reference resistor and at least one internal reference current is generated in response to flow of the at least one internal reference current, in which the current-drive circuit is operable to sum up the at least one internal reference current in a desired number and output a desired number of internal reference currents.

Furthermore, the current-drive circuit is constructed such that the reference current generation section further includes a plurality of current adjustment resistors and operates so that a reference voltage generated across the reference resistor is applied across said plurality of current adjustment resistors to generate a plurality of internal reference currents According to the above-described configuration of current-drive circuit, the resistance value of the current adjustment resistor included in the current-drive circuit is varied to allow drive current to be supplied to the display element of the display panel to approximate the drive current represented by drive current versus input signal characteristics (i.e., gamma characteristics).

According to the, invention, a device includes: first and second terminals; a first resistor connected between the first and second terminals to receive a reference current; and a current generation circuit responding to the reference current and generating first current.

The device constructed as described above may be configured so that the current generation circuit includes a second resistor, a voltage applying circuit responding to a voltage at one end of the first resistor and applying a driving voltage to one end of the second resistor, and a first driving circuit responding to a voltage at the other end of the first resistor and driving the other end of the second resistor such that the first current flows through the second resistor.

The device constructed as described above may further be configured so that the current generation circuit further includes a third resistor having one end applied with the driving voltage and a second driving circuit responding to the voltage at the other end of the first resistor and driving the third resistor such that second current flows through the third resistor.

The device constructed as described above may further be configured so that the device further includes an output terminal, a first switch supplying, when activated, the first current to the output terminal, and a second switch supplying, when activated, the second current to the output terminal.

The device constructed in accordance with the invention provides the same beneficial effects as those explained in the description of the aforementioned inventive current-drive apparatus and current-drive circuit.

DETAILED DESCRIPTION OF THE PREFERRED EMBODIMENTS

Figure 3:
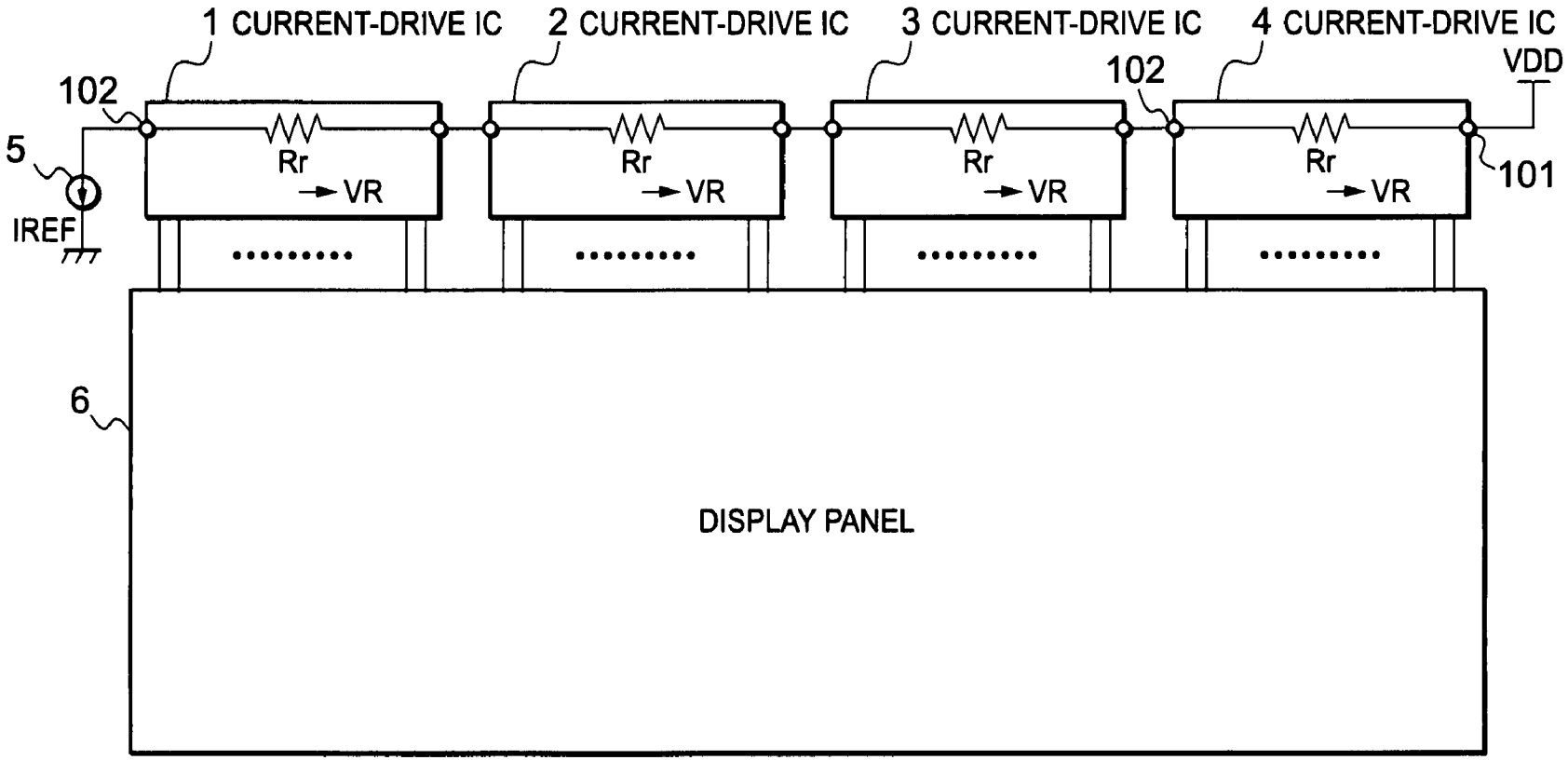
FIG. 3 is a diagram illustrating geometrical relationship between the current-drive ICs and a display panel in a first embodiment of the invention.

First, outline of the present invention is described. FIG. 3 illustrates geometric relationship between a current-drive apparatus of the invention and a display panel driven by the current-drive apparatus (consisting of current-drive ICs) of the invention. As shown in FIG. 3, current-drive ICs IC1 to IC4 according to the invention have reference resistors Rr respectively and those reference resistors Rr are connected in series, and further, one of the reference resistors Rr, positioned on the lowest potential side, is connected to an external reference current source 5. Providing the reference resistor Rr between two terminals 101, 102 within each of the current-drive ICs IC1 to IC4 allows external reference current provided by an external current source IREF to flow through the reference resistor Rr, generating a voltage drop VR across the resistor Rr and thereby equalizing brightness of light emitted from light emitting elements on a display device.

Though not shown in figures, the display panel such as a liquid crystal display panel has drive devices, disposed at the peripheries of the display panel, for driving a liquid crystal panel. In this case, the drive devices are a source driver for driving source lines by outputting a drive signal to each of the source lines and a gate driver for activating gate lines to drive a plurality of source lines in a time-division manner.

The current-drive apparatus of the invention is constructed such that reference resistors Rr contained respectively in the plurality of current-drive ICs IC1 to IC4 and the reference current source 5 are connected in cascade, and the external reference current IRef is caused to flow through the individual resistors Rr in order to generate a voltage drop VR across each of the resistors Rr. Through use of the voltage drop VR, a uniform amount of current generated by reference to the reference current provided by the reference current source 5 can be caused to flow within each of the current-drive ICs IC1 to IC4.

Utilizing the above-described current-drive apparatus consisting of the current-drive ICs IC1 to IC4 makes it possible to output highly precise drive current from the current-drive ICs IC1 to IC4 to the display panel 6 and further, apply gamma correction to the drive current.

First, a first embodiment of the invention will be explained with reference to the accompanying drawings.

Figure 4:
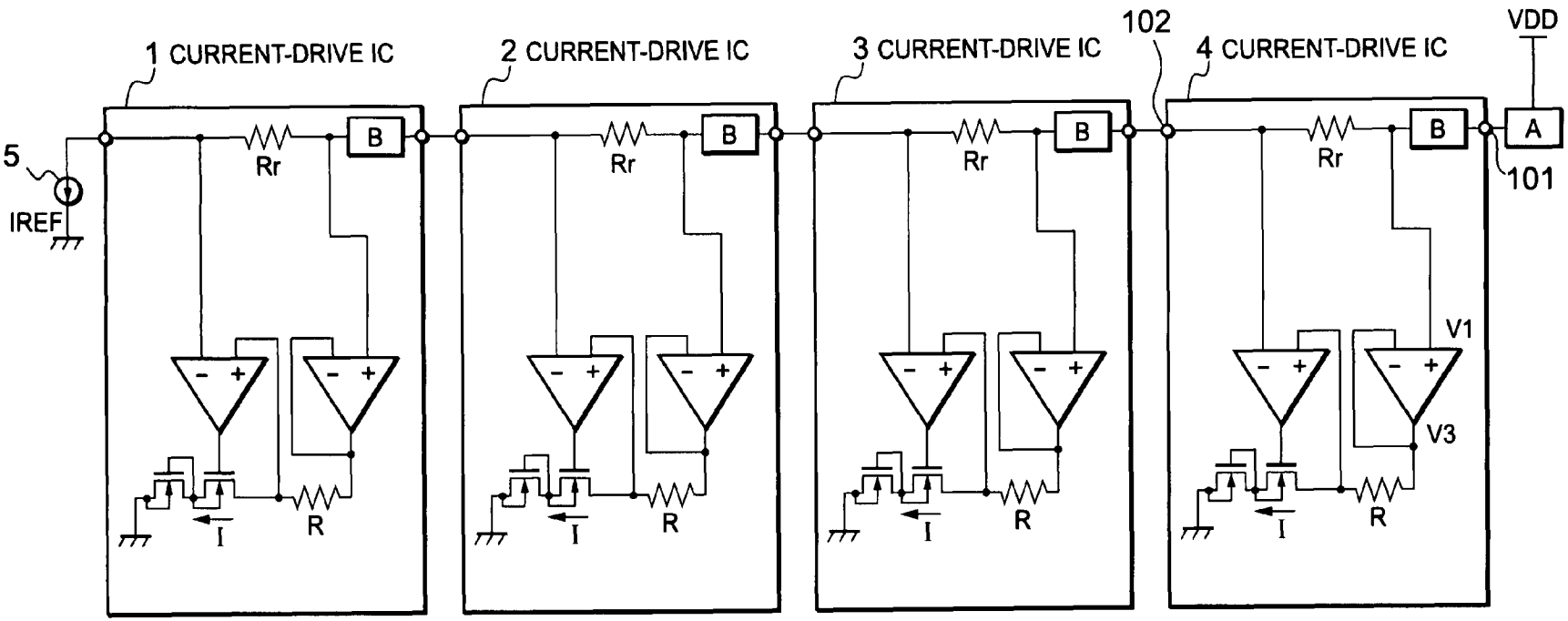
FIG. 4 illustrates the configuration of current-drive ICs of the first embodiment of the invention.

FIG. 4 illustrates the configuration of current-drive ICs according to the first embodiment. Referring to FIG. 4, the current-drive apparatus of the invention is constructed such that current-drive ICs IC1 to IC4 and a reference current source 5 are connected in cascade between a high voltage supply VDD and a low voltage supply GND. Accordingly, reference resistors Rr incorporated within the individual current-drive ICs IC1 to IC4 and the reference current source 5 are also connected in cascade to allow the external reference current IRef to flow from the high voltage supply VDD through the reference resistors Rr of the individual current-drive ICs IC1 to IC4.

Figure 5:
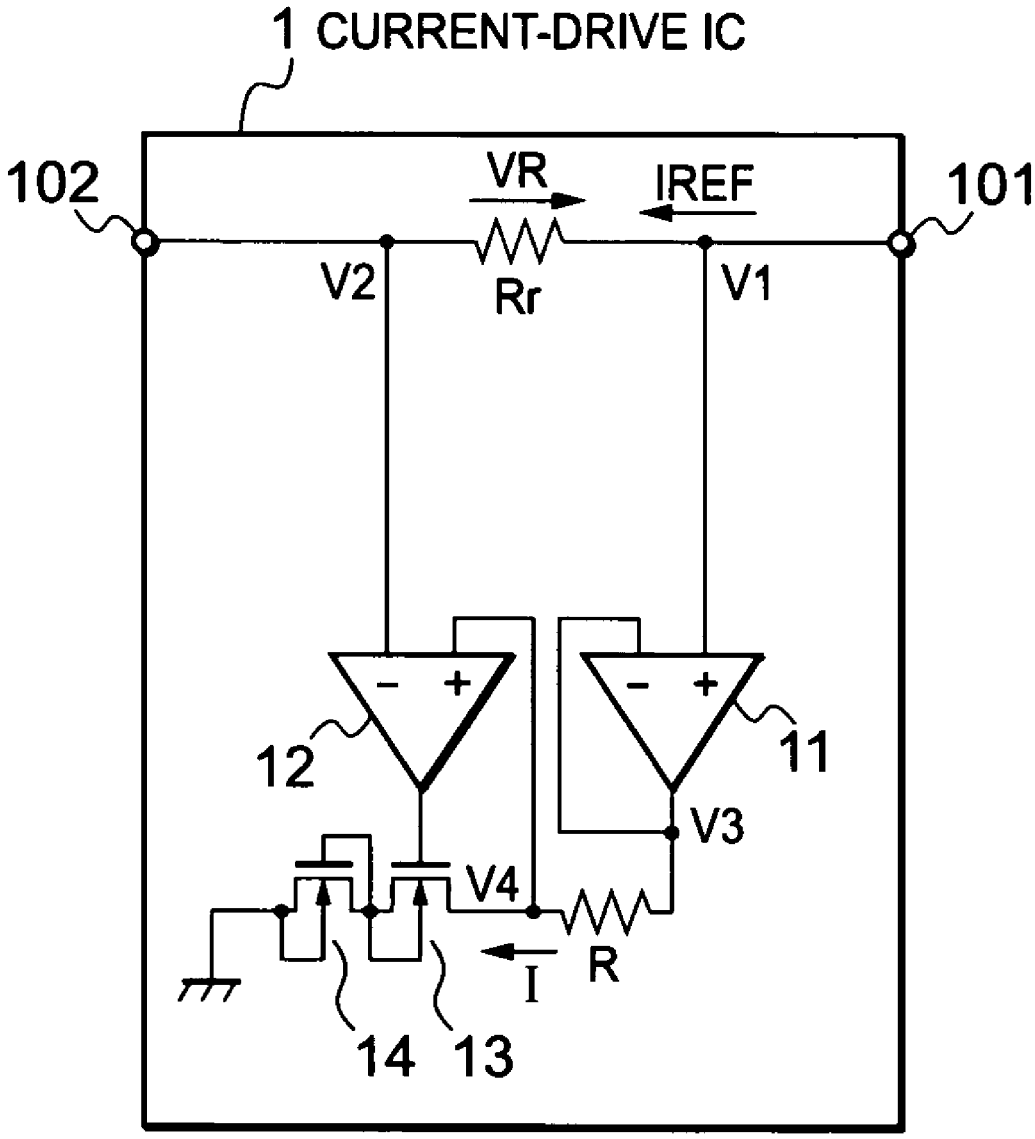
FIG. 5 illustrates the configuration of a current source within the current-drive IC of the first embodiment of the invention.

FIG. 5 illustrates the configuration of the current-drive IC1. Referring to FIG. 5, the current-drive IC1 includes the reference resistor Rr, operational (OP) amplifiers 11, 12, a current-adjustment resistor R, and reference MOS transistors 13, 14 (constituting a reference current part), all of which constitute a reference current generation section in a current-drive IC. The reference resistor Rr is connected between terminals 101 and 102 of each of the current-drive ICs IC1 to IC4 to-divide the high voltage supply VDD into a plurality of voltages (refer to FIG. 4). The OP amplifier 11 is used as a voltage follower and receives a voltage V1 appearing at a higher potential end of the reference resistor Rr through a non-inverting input terminal (+) of the amplifier and outputs a voltage V3 equal to the voltage V1. A voltage V4 is generated by allowing internal reference current I to flow from the output terminal of the OP amplifier 11 through the current-adjustment resistor R.

The OP amplifier 12 receives a voltage V2 appearing at a lower potential end of the reference resistor Rr through an inverting input terminal (−) of the amplifier and outputs the voltage V2 to a lower potential end of the current-adjustment resistor R. Accordingly, a voltage nearly equal to the voltage applied across the reference resistor Rr is applied across the current-adjustment resistor R to allow internal reference current I to flow through the reference transistors 13, 14.

It should be noted that the voltage V1 at the non-inverting input terminal (+) and the voltage V3 at the inverting input terminal (−) of the OP amplifier 11 are equal to each other because an OP amplifier fundamentally has imaginary short-circuit points at those two terminals, and further, the voltage V2 at the inverting input terminal (−) and the voltage V4 at the non-inverting input terminal (+) of the OP amplifier 12 are equal to each other for the same reason.

Accordingly, the equations V1=V3 and V2=V4 result causing voltages across the resistors R and Rr to become equal to each other, leading to establishment of the following equation:

$$I = I\text{Ref.times.}(Rr/R) \quad (1)$$

The above equation teaches that internal reference current I can be generated within each of the current-drive ICs IC1 to IC4 by reference to the external reference current IRef.

Referring again to FIG. 5, .delta.I, which is the amount of displacement of the internal reference current I from the external reference current IRef, is calculated as follows based on the assumption that .delta.R represents the difference between the resistance values of the reference resistor Rr and current-adjustment resistor R, and .delta.Vos represents the difference between the offset voltages of the OP amplifiers 11 and 12:

$$\Delta I = \sqrt{\left(\frac{\Delta R \times I}{R}\right)^2 + 2 \times \left(\frac{\Delta V_{OS}}{V_r} \times I\right)^2} \tag{2}$$

where the equations, R=Rr and I=IRef, are assumed.

When assuming I=10 μA, R=200 kilo-ohms, .delta.R=1 kilo-ohms, and .delta.Vos=5 mV, .delta.I=0.06 μA results meaning that the displacement of the internal reference current I from the external reference current IRef becomes 0.6% of the external reference current IRef.

However, the displacement of the internal reference current I from the external reference current IRef becomes the same regardless of where the current-drive IC is located within the current-drive apparatus and therefore, the degree of the displacement of the internal reference currents I generated within the current-drive ICs IC1 to IC4 from the external reference current IRef can be made approximately the same.

Figure 1:
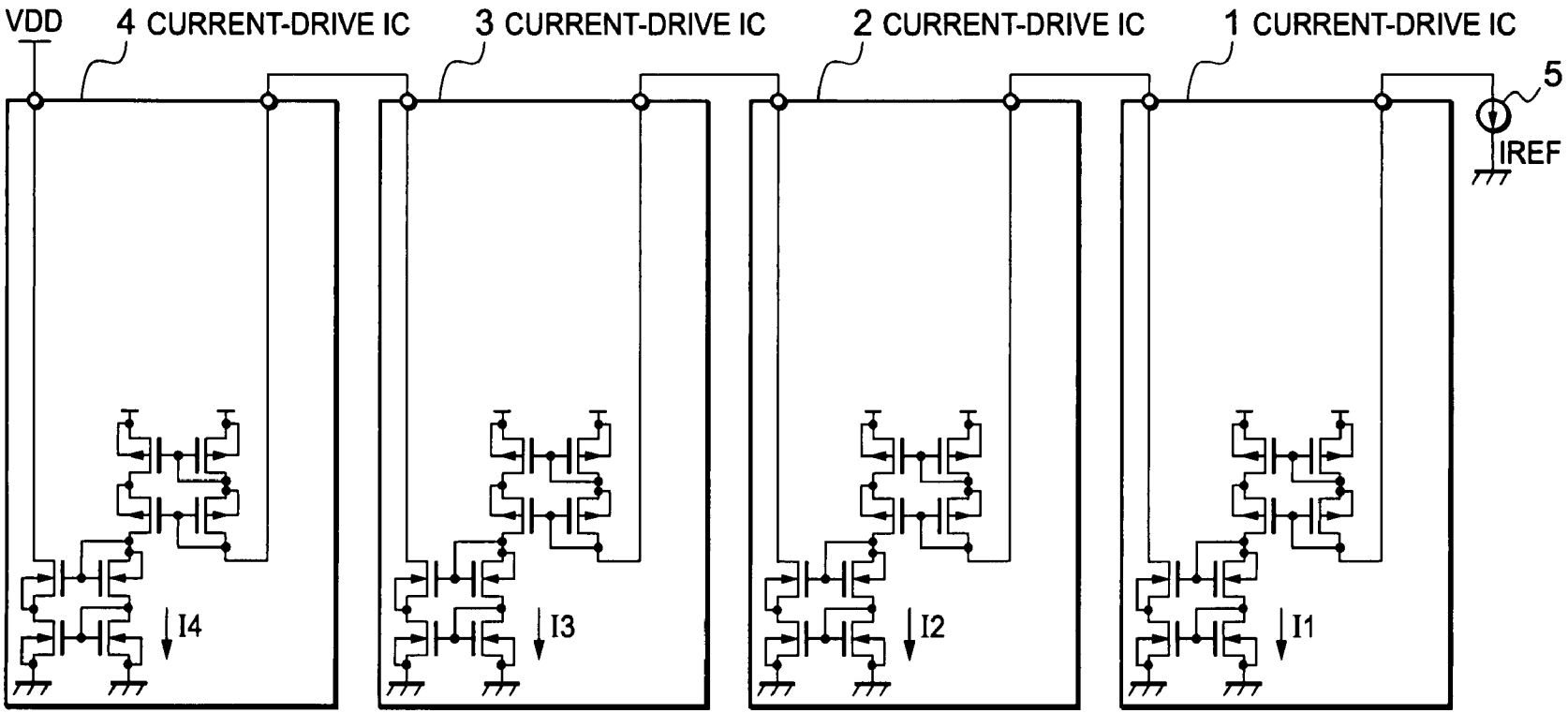
FIG. 1 PRIOR ART
FIG. 1 illustrates the configuration of a conventional current-drive apparatus incorporating a plurality of current-drive ICs.

On the other hand, referring to FIG. 1 illustrating Japanese Patent Application No. 13 (2001)-42827, the current-drive apparatus is constructed such that a plurality of current-drive ICs IC1 to IC4, each containing current mirror (current mirror ratio: 1) circuits connected in cascade, are connected in cascade and therefore, displacement delta.I4 of internal reference current I generated within the current-drive IC4, which is located farthest from the reference current source IREF, from the external reference current IRef becomes largest.

That is, the relationship, delta.I1<delta.I2<delta.I3<delta.I4, results, meaning that displacement of internal reference current I generated within the current-drive IC, which is located farthest from the reference current source IREF, from the external reference current IRef becomes larger and larger in proportion to the number of current-drive ICs.

Referring again to FIG. 5, when a well-known offset canceling circuit is added to each of the OP amplifiers 11, 12, the .delta.Vos represented by the equation (2) becomes nearly zero, allowing the .delta.I represented by the equation (2) to become further reduced.

Moreover, as can be understood from the equation (2), adding the offset canceling circuit to each of the OP amplifiers 11, 12 prevents the voltage drop VR shown in FIG. 5 from affecting the displacement .delta.I of internal reference current I from the external reference current IRef. This enables reduction in resistance value of the resistor Rr, leading to reduction in the voltage drop VR.

That is, adding the offset canceling circuit to each of the OP amplifiers 11, 12 shown in FIG. 5 allows reduction in the voltage drop VR across the resistor Rr, permitting greater number of current-drive ICs to be connected in cascade.

It should be noted that the current-drive apparatus of the first embodiment is constructed such that the OP amplifiers 11, 12 shown in FIG. 4 and contained in each of the current-drive ICs IC1 to IC4 have a high voltage supply VDD as an operational power supply, and the configuration of the current-drive IC shown in FIG. 5 is applied to each of the current-drive ICs IC1 to IC4 shown in FIG. 4. In this case, the voltage V1 in the current-drive IC4 shown in FIG. 4 equals the high voltage supply VDD.

The operational voltage supply for the OP amplifier 11 in the current-drive IC4 of FIG. 4 is the high voltage supply VDD and the voltage V1 appearing at the input terminal of the OP amplifier 11 equals VDD. Accordingly, an equation V3 (the voltage appearing at the output terminal of the OP amplifier 11)=V1=VDD would ideally result. However, in practice, current is supplied to the current adjustment resistor R by allowing certain current to flow through an output transistor of the OP amplifier 11 and therefore, a voltage drop is generated across the output transistor, leading to establishment of relationship V3<VDD=V1. Accordingly, an equation I=IRef does not result. However, if the output transistor of the OP amplifier 11 is implemented by a power transistor with high drive capability, a voltage drop across the power transistor can be made very small, potentially allowing establishment of relationship V3≈VDD=V1. In this case, the output transistor of the OP amplifier 11 becomes very large in size and consumes larger amount of current.

To solve the above-stated problem, a resistor is placed in a location indicated by letter "A," i. e., the resistor is connected between the high voltage supply VDD and the input terminal of the current-drive IC4. In this case, a voltage drop across the resistor A would preferably be, for example, about 500 mV and therefore, the resistor A having a resistance value of 50 kilo-ohms to 100 kilo-ohms and contained in the current-drive IC4 is connected in series to the high voltage supply, allowing establishment of relationship V1<VDD, V1=V3<VDD and I=IRef.

Accordingly, even when the OP amplifier 11 within each of the current-drive ICs IC1 to IC4 shown in FIG. 4 uses the high voltage supply VDD as an operational power supply, placing a resistor having a suitable resistance value in the location indicated by letter "A" (refer to FIG. 4) enables the OP amplifier 11 to have imaginary short-circuit points at its two input terminals, allowing each of the current-drive ICs IC1 to IC4 to generate the internal reference current I represented by the equation I=IRef.

A second embodiment of the invention will be explained with reference to the accompanying drawings.

Figure 6:
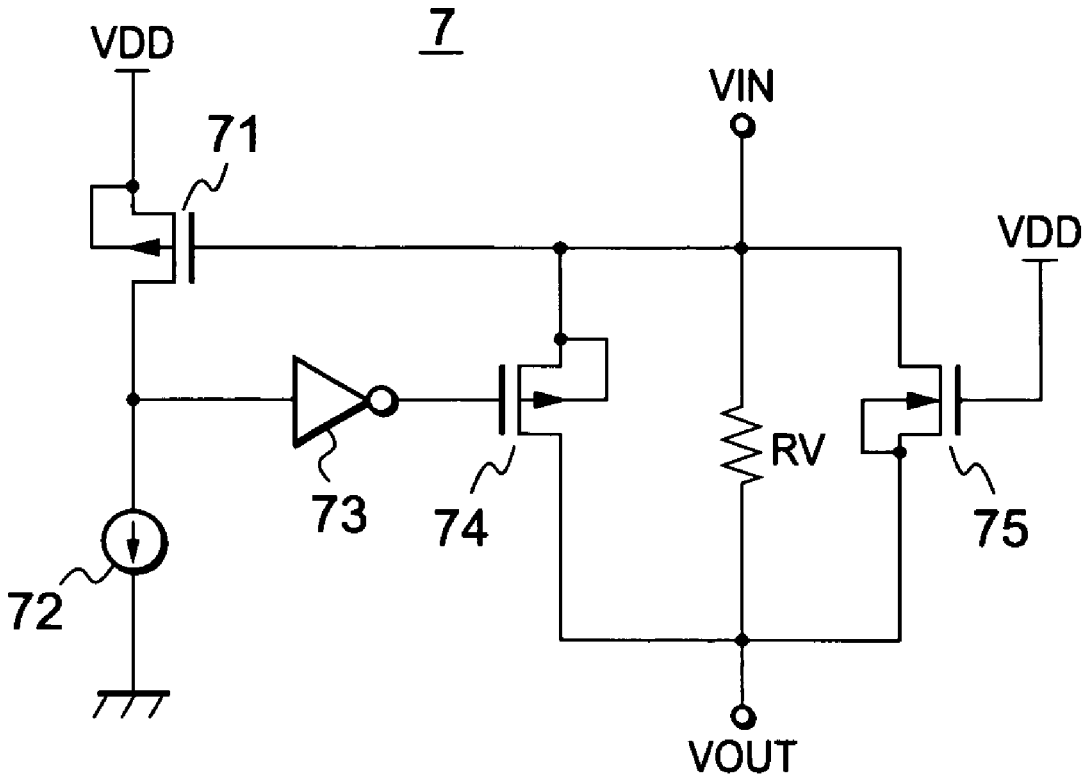
FIG. 6 illustrates the configuration of a voltage drop adjustment circuit according to a second embodiment of the invention.

When the external resistor is not placed in the location indicated by the letter "A" and shown in FIG. 4 in the first embodiment, voltage-drop adjustment circuits 7 need to be placed in locations within the current-drive ICs IC1 to IC4, which locations are indicated by a letter "B." FIG. 6 illustrates the configuration of the voltage-drop adjustment circuit 7. The voltage-drop adjustment circuit 7 includes a first P-channel MOS transistor 71, a constant current source 72, an inverter 73, a second P-channel MOS transistor 74, a third P-channel MOS transistor 75, and a resistor Rv for voltage reduction (or a step-down resistor), in which the first P-channel MOS transistor 71 and the constant current source 72 are connected in cascade between a high voltage supply VDD and a low voltage supply GND. The second P-channel MOS transistor 74 has its source connected to a gate of the first P-channel MOS transistor 71 and an input terminal VIN for voltage reduction, and its drain connected to an output terminal VOUT for voltage reduction, and further, its gate connected via the inverter 73 to a drain of the first P-channel MOS transistor 71. The third P-channel MOS transistor 75 has its gate connected to the high voltage supply VDD. The resistor Rv for voltage reduction is connected between the input terminal VIN for voltage reduction and output terminal VOUT for voltage reduction.

How the voltage-drop adjustment circuit 7 operates will be explained below.

When assuming a voltage appearing at the VIN terminal equals VDD (=10V) and a voltage appearing at the VOUT terminal equals (VDD−2V), the current-drive IC4 out of the current-drive ICs IC1 to IC4 connected in cascade operates so that the N-channel MOS transistor 75 is not turned on and the P-channel MOS transistor 71 also is not turned on, causing an input terminal of the P-channel MOS transistor 73 to be a logic low L (0V) and the gate of the P-channel MOS transistor 74 to be a logic high H (VDD) Accordingly, the P-channel MOS transistor 74 also is not turned on.

That is, any transistor within the current-drive IC4 is not turned on and therefore, current passes through the resistor Rv, causing a voltage drop Rv.times.I across the VIN and VOUT terminals.

Regarding the current-drive IC3, the voltage at the VIN terminal equals (VDD−2V) and the voltage at the VOUT terminal equals (VDD−4V), and therefore, the P-channel MOS transistor 71 is turned on and the P-channel MOS transistor 74 also is turned on. Accordingly, lowering on-resistance of the P-channel MOS transistor 74 allows current to flow through the P-channel MOS transistor 74, causing a voltage drop across the VIN and VOUT terminals to become very small.

It should be noted that the N-channel MOS transistor 75 is weakly turned on. Turning our eyes from the current-drive IC3 to the current-drive IC2 and IC1, the voltage appearing at the terminal VIN equals (VDD−6V) and the voltage appearing at the terminal VOUT equals (VDD−8V), and therefore, both the P-channel MOS transistor 71 and N-channel MOS transistor 75 are strongly turned on.

In this case, although the P-channel MOS transistor 74 is also turned on, the voltage appearing at the terminal VIN is low and therefore, the P-channel MOS transistor 74 is being weakly turned on. That is, the current I primarily passes through the N-channel MOS transistor 75, causing the voltage drop across the voltage drop adjustment circuit 7 of each of the current-drive ICs IC2 and IC1 to be very small, as in the case with the current-drive IC3.

Figure 7A:
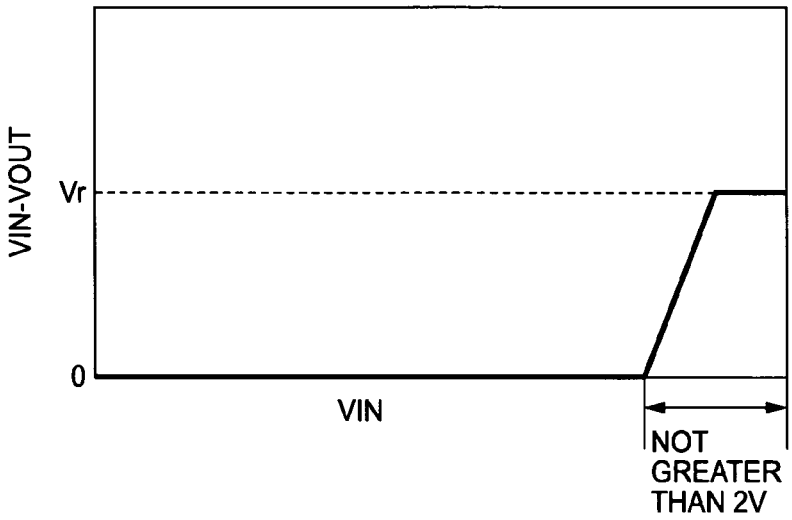
FIG. 7A is the voltage characteristics of the voltage drop adjustment circuit.
Figure 7B:
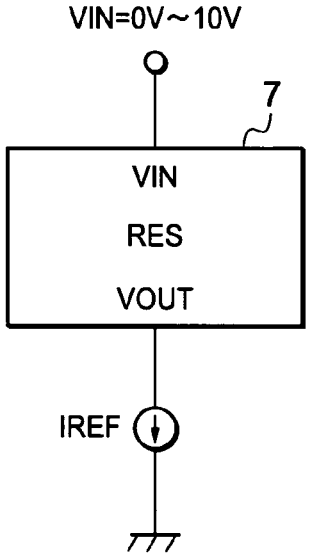
FIG. 7B is a schematic view illustrating how the current-drive apparatus is biased when the voltage characteristics of the voltage drop adjustment circuit are measured.

FIG. 7A is a curve representing voltage characteristics of the voltage drop adjustment circuit 7 of FIG. 6, i.e., relationship between a voltage between the VIN and VOUT terminals and a voltage appearing at the VIN terminal. As shown in FIG. 7B, the characteristics shown in FIG. 7A are obtained by connecting the VOUT terminal of the voltage drop adjustment circuit 7 to the current source IREF and then applying a voltage of between 0 and 10 volts to the VIN terminal thereof. Referring to FIG. 7B, it would become apparent that placing the voltage drop adjustment circuit 7 of FIG. 6 in the section B of FIG. 4 (i.e., connecting in series the voltage drop adjustment circuit 7 to the adjacent current-drive IC) causes a voltage drop only across the section B of the current-drive IC4 positioned nearest to the high voltage supply VDD.

That is, the waveform shown in FIG. 7A indicates that when assuming VDD=10V and the voltage drop Vr=2V, where the voltage drop is across the resistors Rr of the current drive ICs IC1 to IC4, a voltage drop Vr is observed only across the voltage drop adjustment circuit 7 of the current drive IC4 and the voltage drop across the voltage drop adjustment circuits 7 of the remaining current drive ICs becomes approximately zero. Accordingly, the current I=IREF can be supplied inside the individual current drive ICs IC1 to IC4.

A third embodiment of the invention will be explained below.

Figure 8:
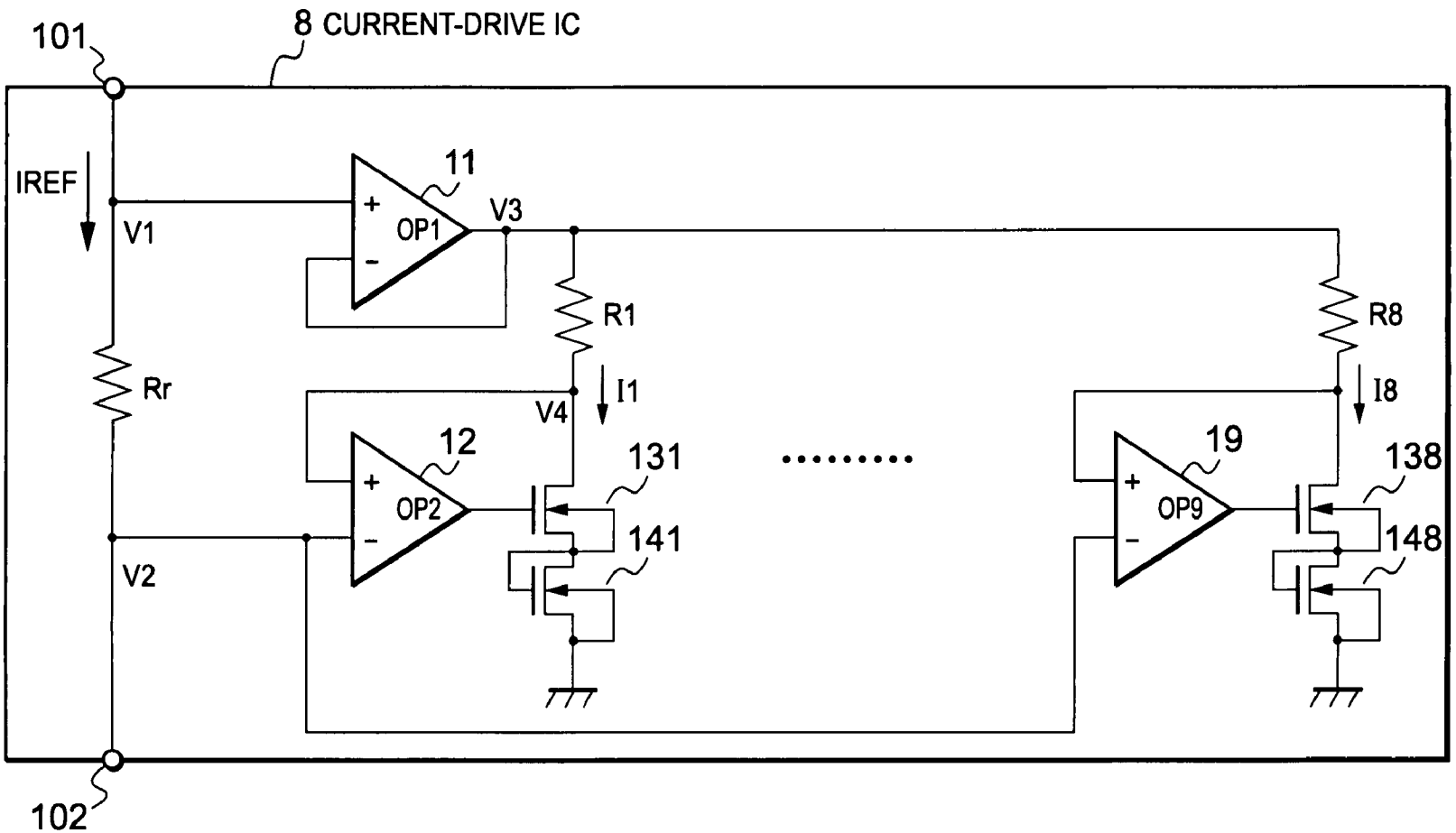
FIG. 8 is a diagram to illustrate a plurality of current sources within the current-drive IC of a third embodiment of the invention.

FIG. 8 illustrates the configuration of a plurality of current sources within a current-drive IC8 of the third embodiment. In this case, current-drive ICs (having the same configuration as that shown in FIG. 4), each having the configuration of current-drive IC of the third embodiment, constitute a current-drive apparatus of the third embodiment. The current-drive IC 8 comprises a reference resistor Rr, OP amplifiers 11 to 19, current adjustment resistors R1 to R8, reference MOS transistors 131 to 138 and 141 to 148 (each set of transistors, such as transistors 131 and 141, constituting a reference current part), all of which constitute a reference current generation section in a current-drive IC. The reference resistor Rr is connected between terminals 101 and 102 of each of the current-drive ICs to divide a high voltage supply VDD into a plurality of voltages. The OP amplifier 11 is used as a voltage follower and allows a voltage V1 appearing at one end of the reference resistor Rr on the side of the high voltage supply to be input to its non-inverting terminal (+) and then be output as a voltage V3 equal to the voltage V1.

Furthermore, the current adjustment resistors R1 to R8 a reprovided to allow output currents I1 to I8 from the OP amplifier 11 to flow through the reference MOS transistors 131 to 138, respectively. The OP amplifiers 12 to 19 operate so that a voltage V2 appearing at the other end of the reference resistor Rr on the side of a low voltage supply GND is input to an inverting terminal (−) of each of the OP amplifiers 12 to 19 and a voltage approximately equal to the voltage V2 is output as a voltage V4 to the non-inverting terminal (+) of each of the OP amplifiers 12 to 19. A differential voltage between the voltages V3 and V4 is applied across each of the current adjustment resistors R1 to R8 to allow the currents I1 to I8 to flow through the reference MOS transistors 131 to 138 and 141 to 148 (each set of transistors, such as transistors 131 and 141, constituting a reference current part).

That is, the current-drive IC8 of the embodiment is provided with a plurality of circuits within the current-drive IC used in the aforementioned second embodiment and shown in FIG. 5 (in more detail, plural sets of current adjustment resistor, lower-side OP amplifier and two series-connected reference MOS transistors are provided in the current-drive IC8 of the embodiment) and then the current adjustment resistors R1 to R8 are adjusted to allow adjustment of the currents I1 to I8 flowing through the resistors R1 to R8, enabling the current-drive IC8 to have a plurality of current sources provided therein.

Also in the third embodiment, a resistor having a resistance value of 50 kilo-ohms to 100 kilo-ohms is placed in a section of the current-drive apparatus of the third embodiment, corresponding to the section A of FIG. 4, and connected in series to the high voltage supply to establish the relationship V1<VDD. Therefore, also in the current-drive IC8 of the third embodiment, since the equation V1=V3, i.e., I=IRef is available for the circuit of the third embodiment as is the case with the embodiment shown in FIG. 5, even when the voltage supply for the OP amplifier 11 within the current-drive IC8 would be the high voltage supply VDD, placing the resistor having a suitable resistance value in a section of the current-drive apparatus of the third embodiment, corresponding to the section A of FIG. 4, allows the OP amplifiers 11 to normally operate and then permits the current I represented by the equation I=IRef to be supplied inside the current-drive ICs of the current-drive apparatus of the third embodiment.

Alternatively, placing in a section of the current-drive apparatus of the third embodiment, corresponding to the section B of FIG. 4, the voltage drop adjustment circuit 7 shown in FIG. 6 and connected in series to the adjacent current-drive IC makes it possible to cause a voltage drop only across the corresponding section of the current-drive apparatus of the third embodiment, which section is located nearest to the high voltage supply terminal VDD.

A fourth embodiment of the invention will be explained below.

A current-drive IC8 of the fourth embodiment has the same configuration as that shown in FIG. 8 and only the current-drive IC8 constitutes a current-drive apparatus of the fourth embodiment. The current-drive IC 8 of the fourth embodiment comprises a reference resistor Rr, OP amplifiers 11 to 19, current adjustment resistors R1 to R8, reference MOS transistors 131 to 138 and 141 to 148, all of which constitute a reference current generation section. The reference resistor Rr is connected between a high voltage supply VDD and a low voltage supply GND. Though not shown, also in this case, a resistor for voltage reduction is inserted between a terminal 101 on the side of VDD and the high voltage supply VDD. The OP amplifier 11 is used as a voltage follower and allows a voltage V1 appearing at one end of the reference resistor Rr on the side of the high voltage supply to be input to an non-inverting terminal (+) and then be output as a voltage V3 equal to the voltage V1.

Furthermore, the current adjustment resistors R1 to R8 are provided to allow output currents I1 to I8 from the OP amplifier 11 to flow through the reference MOS transistors 131 to 138, respectively. The OP amplifiers 12 to 19 operate so that a voltage V2 appearing at the other end of the reference resistor Rr on the side of the low voltage supply GND is input to the inverting terminal (−) of each of the OP amplifiers 12 to 19 and a voltage approximately equal to the voltage V2 is output as a voltage V4 to the non-inverting terminal (+) of each of the OP amplifiers 12 to 19. A differential voltage between the voltages V3 and V4 is applied across each of the current adjustment resistors R1 to R8 to allow the currents I1 to I8 to flow through the reference MOS transistors 131 to 138 and 141 to 148.

Although the current-drive IC8 of the third embodiment is configured so that a plurality of current sources are provided in each of the plurality of current-drive ICs such as the current-drive ICs IC1 to IC4 explained in the description of FIG. 4, single current-drive IC8 is incorporated in a compact cellar phone having a display panel in the fourth embodiment.

That is, in view of application of current-drive IC to a display device having a compact display panel, the number of driver data lines for providing electrical connection between a current-drive IC and a display panel is small and therefore, only one chip is typically incorporated in a display device as a current-drive IC for driving a display panel.

Accordingly, even in a case where instead of a plurality of current-drive ICs, a single current-drive IC is incorporated in a display device having a display panel, the single current-drive IC is able to have a plurality of current sources provided therein as shown in the embodiment.

A modification of the aforementioned fourth embodiment will be explained with reference to FIG. 9. The current-drive IC of FIG. 8 is configured so that the output terminal of each of the OP amplifiers 12 to 19 is connected to the gate terminal of each of the reference MOS transistors 131 to 138 located on the side of the current adjustment resistors R1 to R8. A current-drive IC 58 of FIG. 9 is configured so that the output terminal of each of the OP amplifiers 12 to 19 is connected to the gate terminal of each of the reference MOS transistors 161 to 168 located on the side of the ground GND.

Figure 9:
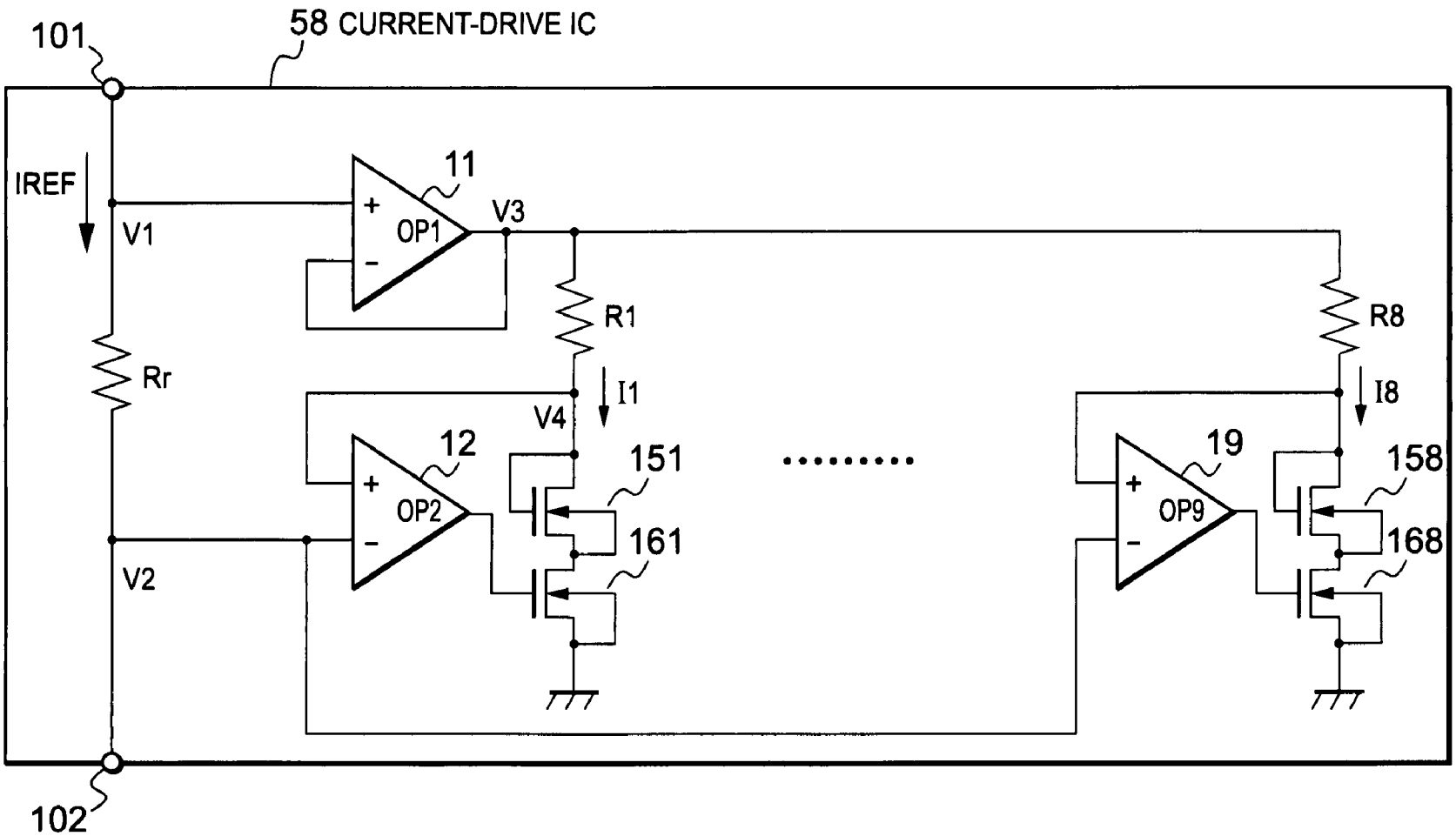
FIG. 9 illustrates the configuration of a current-drive IC of the modification of a fourth embodiment of the invention.

In a case where a single current-drive IC is incorporated in a cellar phone having a compact display panel, even the circuit shown in FIG. 9 is able to constitutes a constant current supply circuit.

That is, when a plurality of current-drive ICs IC1 to IC4 are connected as shown in the other embodiments, the voltage V3 appearing at the terminal 101 and the voltage V4 appearing at the terminal 102 in the individual current-drive ICs IC1 to IC4 are different from one another and therefore, the current-drive IC shown in FIG. 9 cannot be employed in the other embodiments.

Figure 11:
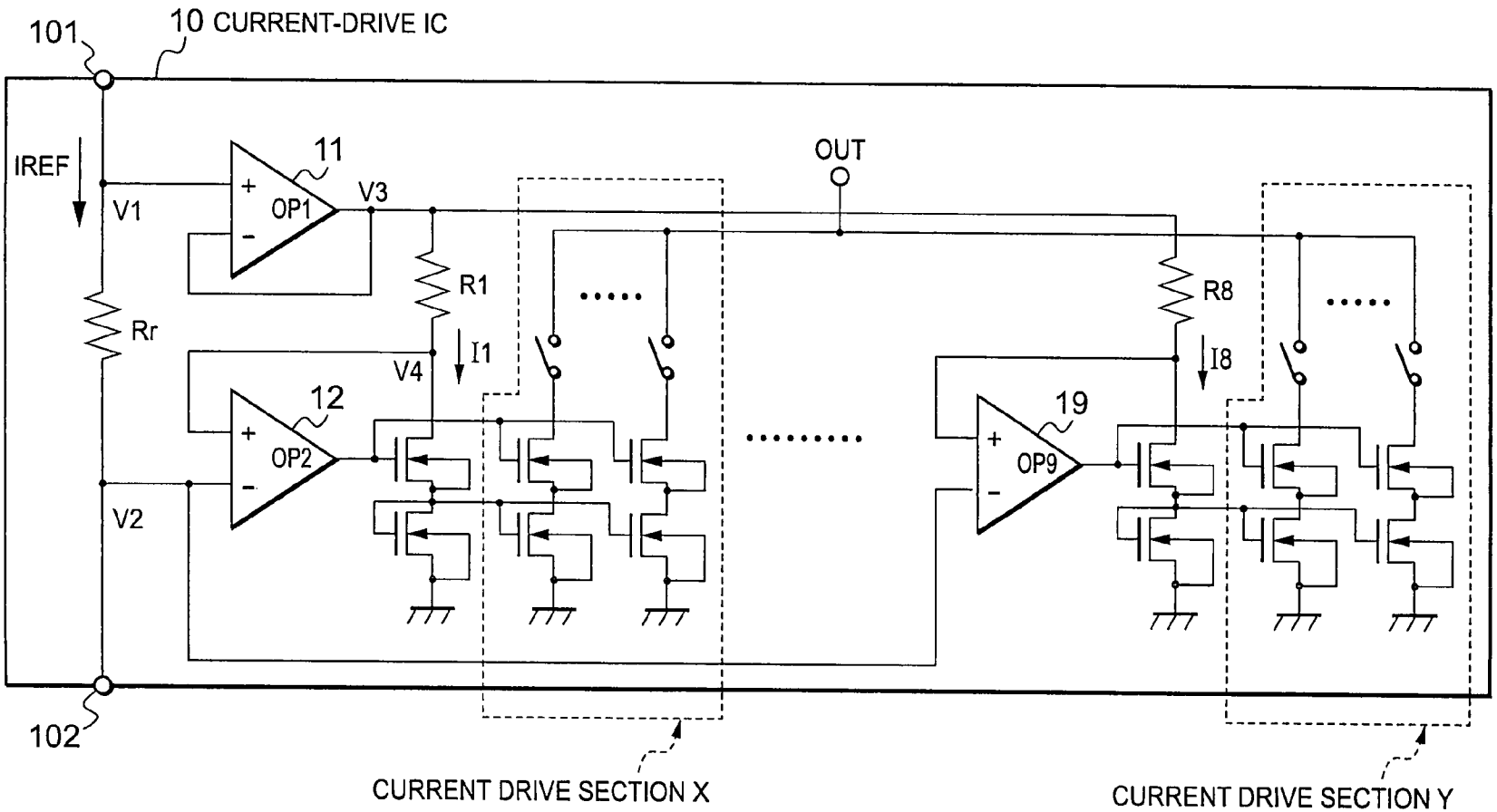
FIG. 11 illustrates the configuration of a circuit combining the current sources and the current-drive IC of the fifth embodiment of the invention.

For instance, when the current-drive IC of FIG. 9 is disposed at a position where the current-drive IC4 located near the high voltage supply VDD is placed, the voltage V4 appearing at the terminal 102 becomes equal to a voltage of (VDD−3V) to (VDD−2V) and therefore, connection of the circuit (i.e., one of plural sets of current adjustment resistor, lower-side OP amplifier and two series-connected reference MOS transistors) of interest shown in FIG. 9 to each of drive sections X and Y of FIG. 11, which sections will be described later, causes the voltage range over which a potential appearing at an output terminal OUT shared by the drive sections moves to become narrower.

This is because a gate voltage of a second MOS transistor of a current mirror circuit equals a voltage V4 of (VDD−3V) to (VDD−2V).

Therefore, even when a single current-drive IC is incorporated in a display device, setting the voltage V4 appearing at the terminal 102 at as low level as possible prevents a potential at the terminal OUT from moving over a limited range of voltages.

A fifth embodiment of the invention will be explained below.

Figure 10:
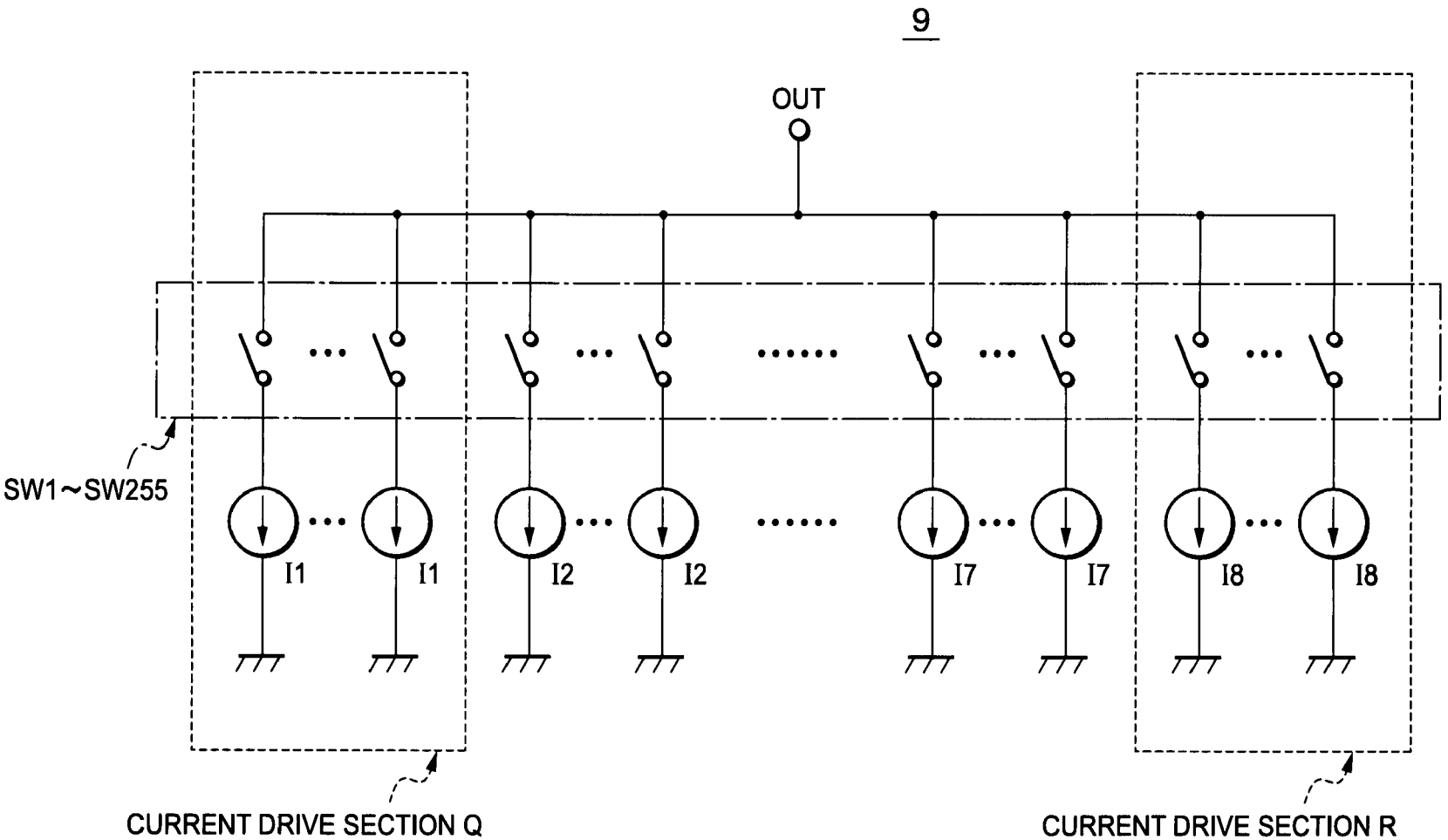
FIG. 10 illustrates the configuration of a current-drive IC of a fifth embodiment of the invention.

FIG. 10 illustrates the configuration of a current-drive circuit according to the fifth embodiment. The current-drive circuit 9 is realized by employing the current-drive IC 8 which allows a plurality of constant currents I1 to I8 to flow inside the current-drive IC and has been explained in the description of the aforementioned third embodiment. Furthermore, a current-drive IC constructed in combination of, for example, the current-drive IC of FIG. 8 and the current-drive circuit of FIG. 10 is illustrated in FIG. 11. Though not shown, a current-drive IC may be constructed in combination of the current-drive IC of FIG. 9 and the current-drive circuit of FIG. 10.

As shown in FIG. 10, the current-drive circuit 9 constitutes a current drive section having a plurality of current drive sections, in which red (R), green (G) and blue (B) are represented at 256 (8 bit) gray scale levels, and constant currents I1 to I8 are generated by a plurality of current sources in the same manner as that explained in the description of the aforementioned current-drive IC of FIG. 8.

That is, the current-drive circuit 9 comprises a current output terminal OUT, 255 current sources I1 to I8, and selection switches SW1 to SW255 connected in parallel between the current output terminal OUT and the current sources I1 to I8. In this case, for example, a set of current sources I1 makes up a current drive section Q and a set of current sources I8 makes up a current drive section R in a current-drive IC, as shown in FIG. 10.

In this case, the current drive sections X and Y of FIG. 11 correspond to the current drive sections Q and R of FIG. 10. Note that the currents I1 to I8 are different from the eight binary-weighted constant currents.

Figure 2:
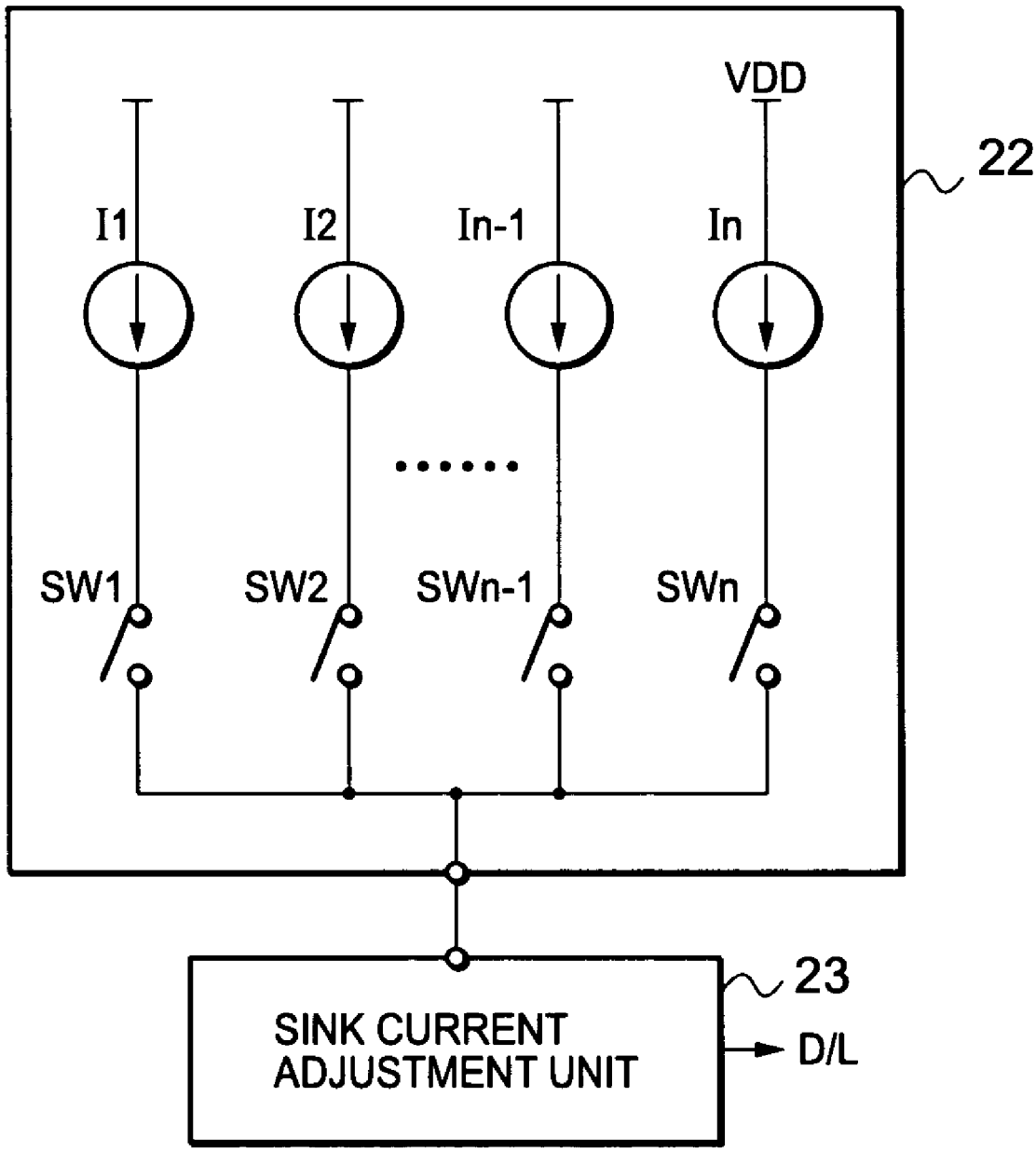
FIG. 2 PRIOR ART
FIG. 2 illustrates the configuration of a general current-drive apparatus.

That is, when eight binary-weighted constant currents are employed in a current-drive circuit, eight current sources are used for supplying currents scaled by a factor of two relative to one another to achieve a 128:64: 32:16: 8:4: 2:1 scaling ratio. Those current sources are selected using switches to obtain 1 to 255 current levels (corresponding to current levels supplied by a 255 full scale resolution current-drive circuit and the case where n equals 8 in FIG. 2).

However, in the invention, the current flowing through each of the constant current sources I1 to I8 represents 1 LSB (1 gray scale level) and further, current levels of the constant current sources I1 to I8 can appropriately be set different from one another to change a current level or gray scale level corresponding to 1 LSB. For example, current I1 represents 1 LSB in a range of 1 to 32 LSB, current I2 represents 1 LSB in a range of 33 to 64 LSB, and likewise, current I8 represents 1 LSB in a range of 216 to 255 LSB (refer to FIG. 10).

Adjusting the current levels provided by the constant current sources I1 to I8 allows creation of relationship between drive current and input signal, i.e., a gamma curve described later.

It should be noted that when the current-drive circuit of FIG. 10 is configured so that current sunk through the terminal OUT by the current sources of the current-drive circuit is monotonically increased, monotone increase in the magnitude of current sunk by the current-drive circuit is maintained since the drive current is monotonically increased by sequentially turning on the switches SW1 to SW255.

Figure 12:
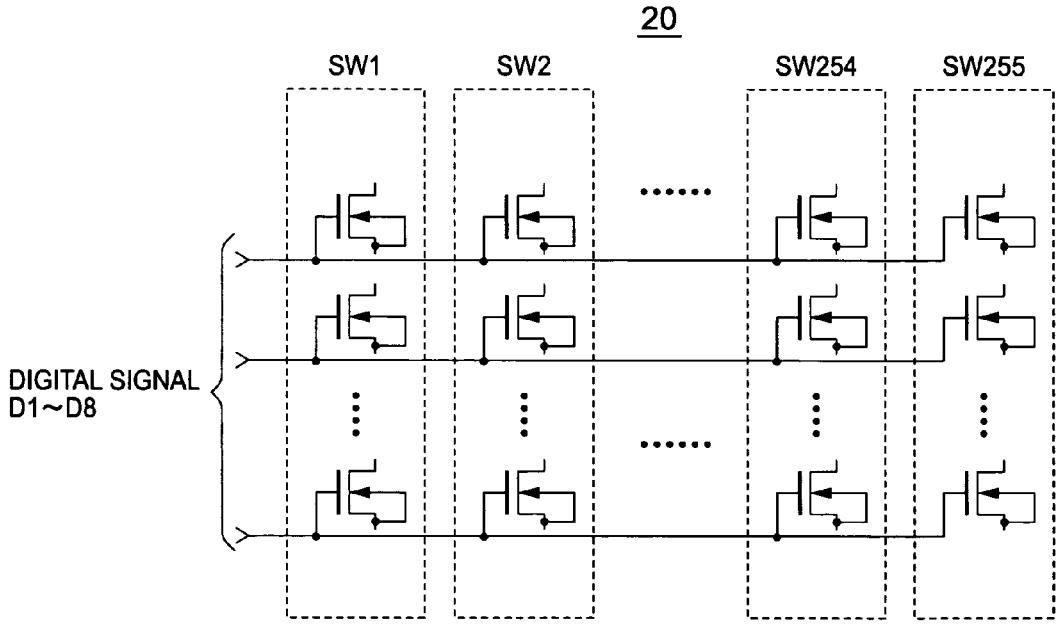
FIG. 12 illustrates the configuration of switches of the current-drive IC of FIG. 11.

FIG. 12 illustrates the configuration of the switches SW1 to SW255 of the current-drive circuit. Since the current sources I1 to I8 sink currents that represent 1 to 255 LSB (i.e., 8 bit resolution), the switches SW1 to SW255 are configured as shown in FIG. 12. That is, when 8 MOS switches of the individual switches SW1 to SW255 each are configured to have its drain and source suitably connected to associated terminals, turning on the switches SW1 to SW255 one by one monotonically increases sink current.

Figure 13:
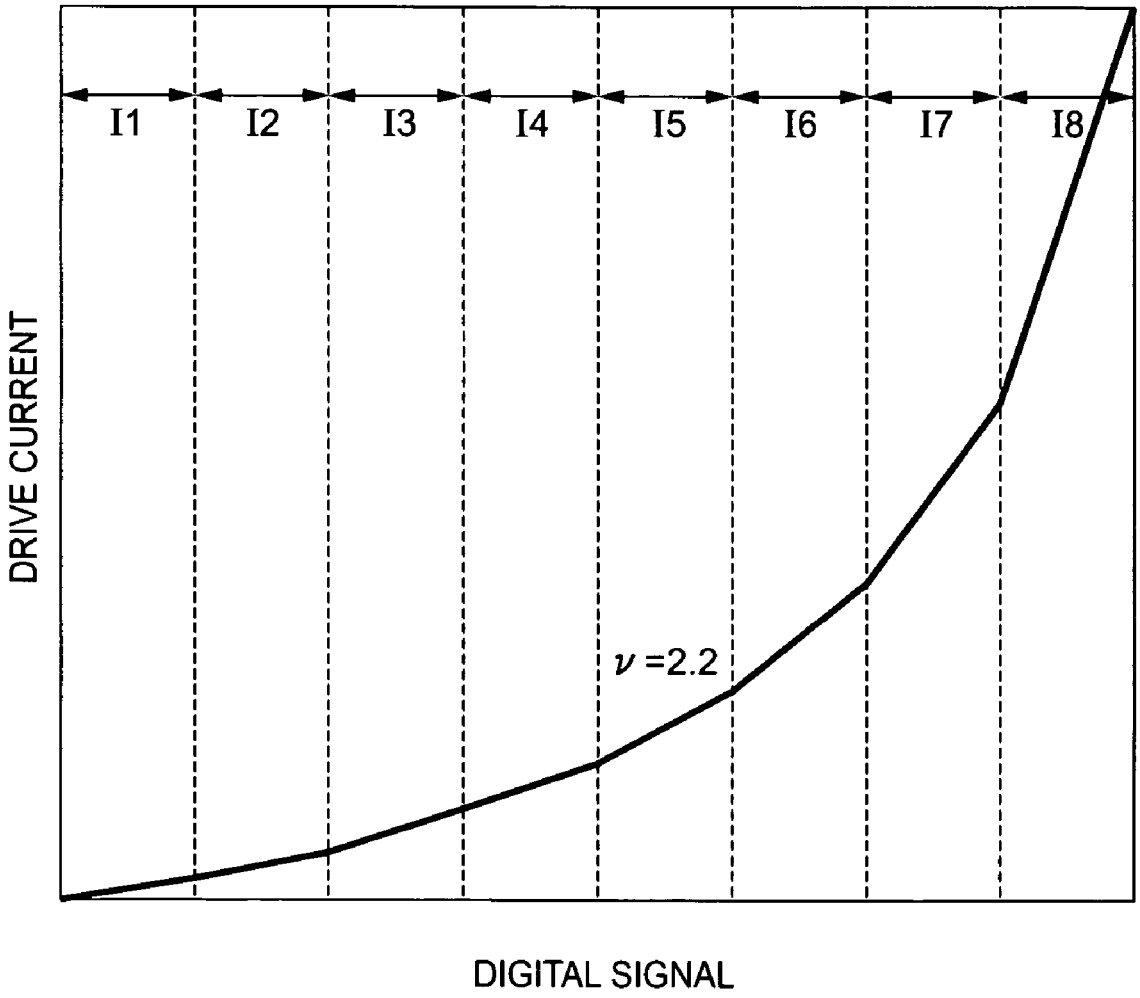
FIG. 13 is a diagram illustrating the drive-current versus input signal characteristics, i.e., gamma characteristics.

When the drive current is monotonically increased, relationship between drive current and input signal becomes a sequential line graph representing a gamma curve as shown in FIG. 13 since the currents sunk by the constant current sources I1 to I8 are weighted differently from one another.

The sequential line graph can be made nearly equal to a gamma curve ($\gamma$=2.2) by adjusting the magnitude of the constant currents I1 to I8 of FIG. 10, that is, adjusting the resistance values of the current adjustment resistors R1 to R8 of FIG. 8. Therefore, the current-drive circuit of FIG. 10 allows application of gamma correction to drive current.

Furthermore, adjusting a segment width (equal width is shown in FIG. 13) corresponding to a set of digital signals covered by each of the constant current sources I1 to I8 of FIG. 12 allows drive current versus digital signal characteristics to approximate a gamma curve ($\gamma$=2.2).

That is, referring to FIG. 13, for example, linearity of the sequential line graph in the segment I8, in which the drive current is large, is distinguished despite desired operation to adjust drive current versus digital signal characteristics so that it approximates the gamma-curve ($\gamma$=2.2). Then, a range of 216 to 255 LSB corresponding to a set of digital signals covered by the constant current source I8 is reduced to a range of, for example, 232 to 255 LSB. In this case, it should be contemplated that since the magnitude of current sunk by the constant current source corresponds to 1 LSB, a range of 1 to 32 LSB corresponding to a set of digital signals covered by the constant current source I1 is increased to a range of, for example, 1 to 48 LSB.

In addition to the above-described adjustment, the current levels of the constant current sources I1 to I8 of FIG. 10, i.e., gamma value of the sequential line graph may also be adjusted by adjusting the resistance values of the resistors R1 to R8 of FIG. 8.

A sixth embodiment of the invention will be explained below.

Figure 14:
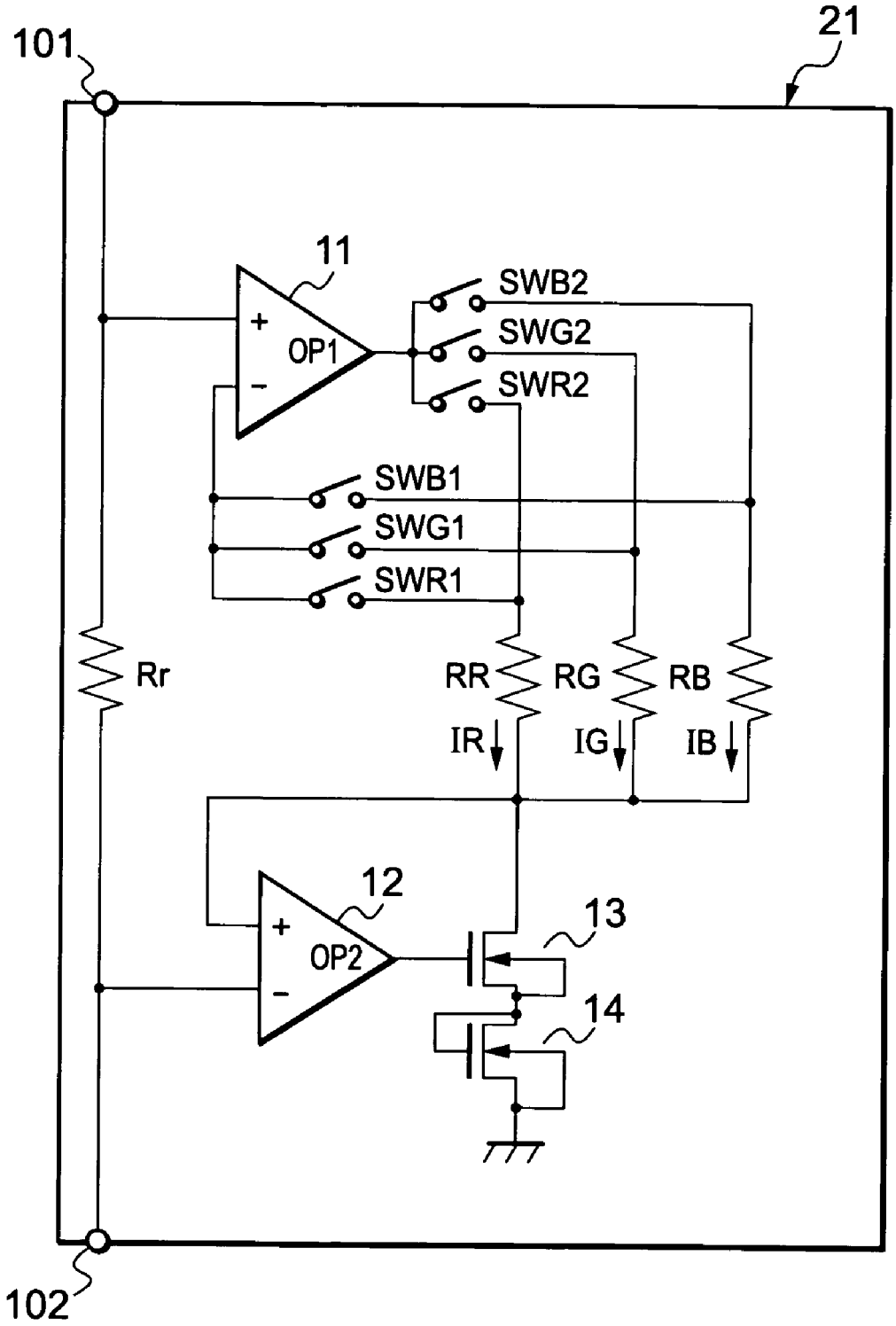
FIG. 14 illustrates the configuration of a current-drive IC generating drive currents varying depending on whether any one of three primary colors, R, G and B is to be displayed, which colors are represented by an input signal, according to a sixth embodiment of the invention.

FIG. 14 illustrates the configuration of a current-drive IC 21 for generating drive currents varying depending on whether any one of three primary colors, R, G and B is to be displayed, which colors are represented by a digital signal, according to the sixth embodiment. The current-drive IC 21 comprises first color switches SWB1, SWG1, SWR1 and second color switches SWB2, SWG2, SWR2, OP amplifiers 11, 12, reference MOS transistors 13, 14, and current adjustment resistors RB, RG, RR, all of which constitute a reference current generation section in a current-drive IC. The first color switches SWB1, SWG1, SWR1 and second color switches SWB2, SWG2, SWR2 are used to select the magnitude of reference current in response to the level of current to be supplied to display elements and to gamma characteristics to be applied to the current-drive IC. The second color switches SWB2, SWG2, SWR2 are disposed respectively between the output terminal of the OP amplifier 11 and the current adjustment resistors RB, RG, RR. Those resistors are connected to a load MOS transistor 13 for the OP amplifier 12.

It should be noted that the current-drive IC 21 of FIG. 14 is illustrated to correspond to one of the internal current sources I1 to I8 of FIG. 8. In this case, the current-drive IC 21 is provided as a current source suited to the case where the levels of drive currents and gamma characteristics corresponding to R, G, B light emitting elements of display panel are different from one another, i.e., the case where a plurality of drive currents should be generated so as to correspond to digital input signals in the aforementioned fifth embodiment.

The current-drive IC 21 operates so that when a light emitting element for emitting R (red) light from a display panel is current-driven, only the switches SWR1, SWR2 are turned on to allow the current IR to pass through the resistor RR to the internal current source.

When a light emitting element for emitting G (green) light from a display panel is current-driven, only the switches SWG1, SWG2 are turned on to allow the current IG to pass through the resistor. RG to the internal current source.

When a light emitting element for emitting B (blue) light from a display panel is current-driven, only the switches SWB1, SWB2 are turned on to allow the current IB to pass through the resistor RB to the internal current source.

As described above, switching the switches of the current-drive IC 21 allows a level of drive current to vary in response to an input digital signal representing one of colors, R, G and B.

It is apparent that difference between the circuit configurations of the sixth embodiment and the aforementioned fifth embodiment is that the circuit of the sixth embodiment includes six switches and resistors RR, RG, RB in addition to the circuit of the fifth embodiment. The current-drive circuit of the sixth embodiment is completely the same as the current-drive circuit 9 shown in FIG. 10. Accordingly, only changing slightly circuit configuration and chip area makes it possible to provide a current-drive IC for driving a display panel in response to a digital signal corresponding to one of colors, R, G and B.

As described so far, the current-drive apparatus for a display device according to the invention comprises an external reference current source and a reference resistor provided between two terminals within each of current-drive ICs so that external reference current generated by the external reference current source flows through the reference resistor creating a voltage drop across the reference resistor in order to equalize the intensity of light emitted by a light emitting element. In this case, the reference resistors of a plurality of the current-drive ICs constructed as described above and the external current source are connected in cascade. Therefore, the current-drive apparatus according to the invention is able to output drive current to a display panel with high accuracy and further apply gamma correction to the drive current, allowing discrimination of the inventive current-drive apparatus for a display panel from other current-drive apparatuses in the market.

It would be apparent to those skilled in the art that the present invention is not limited to the above embodiments and description, but may be changed or modified without departing from the scopes and spirits of appended claims.

Figure 15:
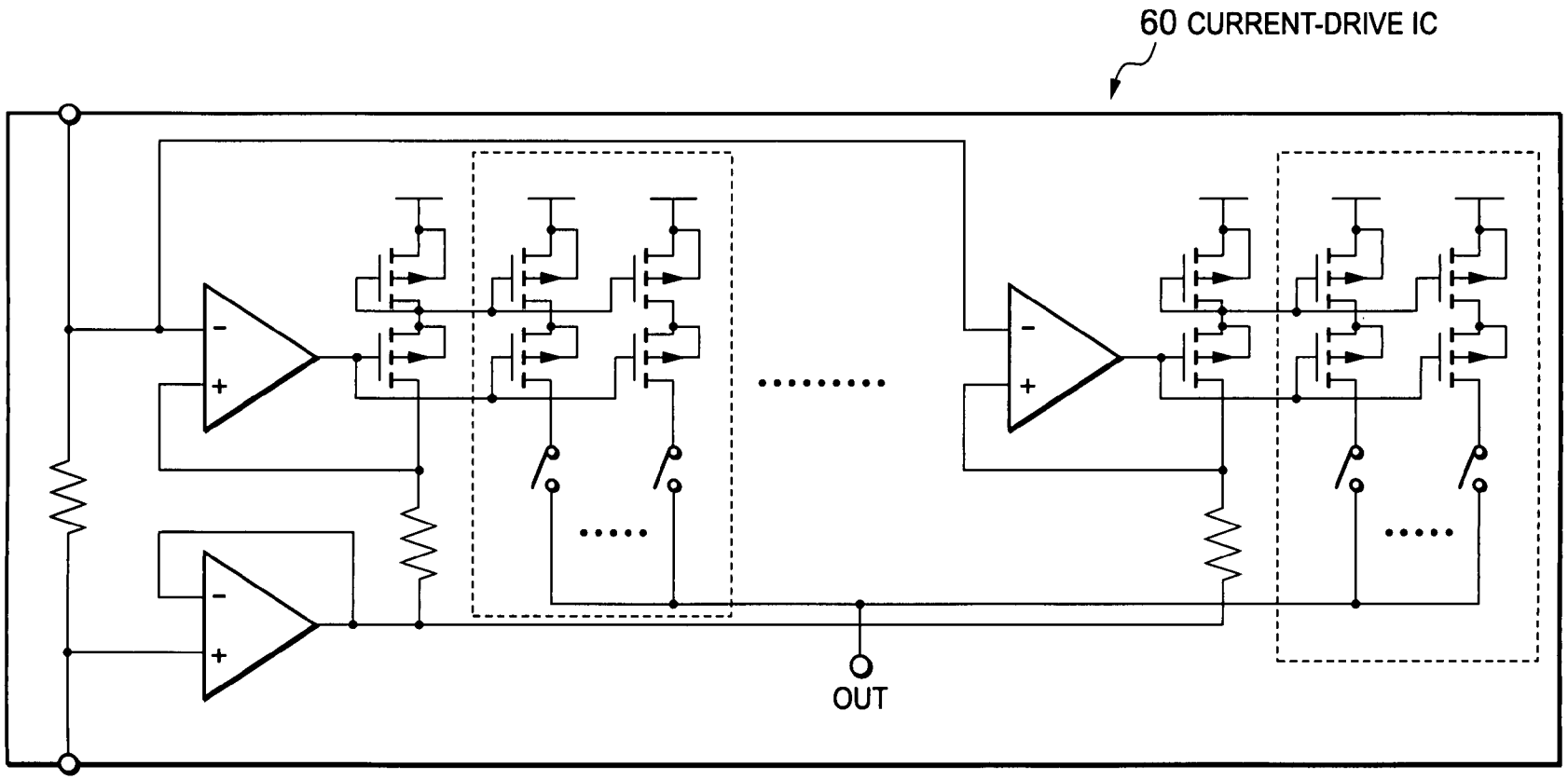
FIG. 15 is the configuration of a current-drive IC for sourcing current to indicate the current-drive apparatus of the invention is able to employ not only the current-drive IC, shown in FIG. 11, for sinking current but a current-drive IC for sourcing current.

For example, in FIG. 11, although the current-drive IC 10 acting to sink drive current through the output terminal is illustrated in the embodiments, a current-drive IC 60 acting to source drive current through an output terminal and shown in FIG. 15 can be employed in the invention. The current-drive IC 60 is constructed such that the inverting terminal and non-inverting terminal of the OP amplifier of the current-drive IC 10 are replaced with each other, and the N-channel reference MOS transistors of the current-drive IC 10 are replaced with P-channel reference MOS transistors. Furthermore, in a current-drive apparatus for sourcing drive current to the outside, a plurality of current-drive ICs 60 are connected in cascade and an external reference current source IREF is inserted between a high voltage supply VDD and the current-drive IC 60 located nearest to the high voltage supply.

What is claimed is:

1. A current-drive apparatus for a display panel, comprising:

a plurality of current-drive circuits, each of said plurality of current-drive circuits including first and second terminals, a reference resistor connected between said first and second terminals and a reference current generation circuit to produce at least one internal reference current responding to a voltage generated based on the reference resistor; and a current source, said current source and said plurality of current-drive circuits being connected such that a current flowing through said current source becomes substantially equal to a current flowing through said reference resistor of each of said current-drive circuits, wherein a current flowing through said reference resistor in a first one of said current-drive circuits flows through said reference resistor in a second one of said current-drive circuits, wherein said current drive circuits are coupled in series in a manner that said first terminal of a preceding one of said current drive circuits is connected to the second terminal of a succeeding one of said current-drive circuits which is adjacent to the preceding one of said current-drive circuits, and wherein at least one of said plurality of current-drive circuits further includes:

a first reference MOS transistor;

a first operational amplifier having a first input coupled to a first node between said first terminal and said reference resistor and a second input coupled to an output thereof;

a second operational amplifier having a first input coupled to a second node between said second terminal and said reference resistor, a second input coupled to a drain of said first reference MOS transistor, and an output coupled to a gate of said first reference MOS transistor; and a current adjustment resistor connected between the drain of said first reference MOS transistor and the output of said first operational amplifier, wherein said current adjustment resistor operates such that a reference voltage generated based on a voltage at both ends of said reference resistor is applied across said current adjustment resistor to generate an internal reference current through said first reference MOS transistor.

2. The current-drive apparatus according to claim 1, wherein each of said plurality of current-drive circuits comprises a voltage adjustment circuit connected to a terminal of said reference resistor on the side of a high voltage supply and wherein said plurality of current-drive circuits are configured so that when said plurality of current-drive circuits are biased, only said voltage adjustment circuit of said current-drive circuit chosen out of said plurality of current-drive circuits and located nearest to said high voltage supply has a voltage drop and the remainder of said plurality of current-drive circuits is short circuited.

3. The current-drive apparatus according to claim 2, wherein said voltage adjustment circuit comprises a high voltage terminal, a low voltage terminal, a step-down resistor connected between said high voltage terminal and low voltage terminal, and first and second MOS transistors having conduction types different from each other and connected in parallel with said step-down resistor, wherein said plurality of current-drive circuits are configured so that when said plurality of current-drive circuits are biased, only said step-down resistor of said current adjustment circuit of said current-drive circuit chosen out of said plurality of current-drive circuits and located nearest to said high voltage supply has a voltage drop and said current adjustment circuit of the remainder of said plurality of current-drive circuits becomes short circuited by turning on of at least one of said first and second MOS transistors.

4. The current-drive apparatus according to claim 1, wherein said at least one of said plurality of current-drive circuits further includes:

at least one additional reference MOS transistor;

at least one additional operational amplifier having a first input coupled to said second node, a second input coupled to a drain of said at least one additional reference MOS transistor, and an output coupled to a gate of said at least one additional reference MOS transistor; and at least one additional current adjustment resistor connected between the drain of said at least one additional reference MOS transistor and the output of said first operational amplifier, wherein at least one additional internal reference current is generated through said at least one additional reference MOS transistor.

5. The current-drive apparatus according to claim 1, wherein said at least one of said plurality of current-drive circuits further includes a second reference MOS transistor disposed between said current adjustment resistor and a low voltage supply in order to allow said internal reference current to flow to said low voltage supply.

6. The current-drive apparatus according to claim 1, wherein each of said plurality of current-drive circuits further comprises at least one current-drive section, wherein each of said at least one current-drive section mirrors corresponding one of at least one internal reference current to generate a plurality of mirror currents and sums up a desired number of mirror currents out of said plurality of mirror currents in order to output sum of said desired number of mirror currents.

7. The current-drive apparatus according to claim 6, wherein each of said at least one current-drive section further comprises a plurality of switches corresponding to said plurality of mirror currents and operates so that said plurality of switches are selectively turned on to allow said sum up of said desired number of mirror currents.

8. The current-drive apparatus according to claim 6, wherein each of said at least one current-drive section further comprises a plurality of switches corresponding to said plurality of mirror currents and operates so that said plurality of switches are selectively turned on to allow said sum up of said desired number of mirror currents and wherein each of said plurality of current-drive circuits operates to sum up at least one set of said desired number of mirror currents and outputs sum of said at least one set of said desired number of mirror currents to said display element, thereby determining brightness of light emitted by said display element.

9. The current-drive apparatus according to claim 4, wherein a set of three sub-resistors is provided as each of said at least one current adjustment resistor so as to correspond to three primary colors and a switch circuit for selecting one of three primary colors is provided between said set of three sub-resistors and said first operational amplifier.

10. The current-drive apparatus according to claim 9, wherein said switch circuit comprises a first switch group provided between said three sub-resistors and an output of said first operational amplifier and a second switch group provided between said three sub-resistors and said non-inverting terminal of said first operational amplifier.

11. A current-drive system for a display panel, comprising:

first and second power source lines;

a plurality of current-drive ICs, each of said plurality of current-drive ICs having first and second terminals and having a first resistor connected between said first and second terminals; and a current source connected to said plurality of current-drive ICs so that said ICs and said current source are connected in cascade with said first and second terminals between first and second power source lines, wherein said ICs are coupled in series between said first power source line and said current source in such a manner that the second terminal of a preceding one of said ICs is connected to the first terminal of a succeeding one of said ICs, wherein at least one of said plurality of current-drive ICs further includes:

a reference MOS transistor;

a first operational amplifier having a first input coupled to a first node between said first terminal and said reference resistor and a second input coupled to an output thereof;

a second operational amplifier having a first input coupled to a second node between said second terminal and said reference resistor, a second input coupled to a drain of said reference MOS transistor, and an output coupled to a gate of said reference MOS transistor; and a second resistor connected between the drain of said reference MOS transistor and the output of said first operational amplifier.

12. The current-drive apparatus according to claim 1, wherein said current-drive circuit is operable to sum up the at least one internal reference current in a desired number and output a desired number of internal reference currents to a display element of said display panel.

* * * * *